US005572979A

United States Patent [19]

Czadzeck

[11] Patent Number: 5,572,979

[45] Date of Patent: Nov. 12, 1996

[54] ENGINE AIR INDUCTION SYSTEM

[75] Inventor: Gerald H. Czadzeck, Bloomfield Twp., Mich.

[73] Assignee: Ford Motor Company, Dearborn, Mich.

[21] Appl. No.: 498,162

[22] Filed: Jul. 5, 1995

[51] Int. Cl.[6] ..... F02B 47/08

[52] U.S. Cl. ..... 123/568; 123/590; 123/591

[58] Field of Search ..... 123/590, 591, 123/568

[56] References Cited

U.S. PATENT DOCUMENTS

| | | | |
|---|---|---|---|
| 1,480,959 | 6/1919 | Secor . | |
| 1,569,610 | 1/1926 | Brush | 123/590 |
| 2,639,230 | 5/1953 | Lefebre | 123/590 |
| 3,747,581 | 7/1973 | Kolb | 123/591 |
| 4,064,857 | 12/1977 | Williams | 123/590 |
| 4,092,966 | 6/1978 | Prosen | 123/590 |
| 4,180,041 | 12/1979 | Miyazaki et al. . | |
| 4,215,663 | 8/1980 | Gaylord . | |
| 4,290,404 | 9/1981 | Hata et al. | 123/568 |
| 4,375,801 | 3/1983 | Eckman . | |
| 4,492,212 | 1/1985 | Dooley . | |
| 4,922,876 | 5/1990 | Mizoguchi et al. | 123/590 |
| 5,237,973 | 8/1993 | Oda | 123/568 |

FOREIGN PATENT DOCUMENTS

| | | | |
|---|---|---|---|
| 1019861 | 11/1957 | Germany | 123/590 |
| 223319 | 9/1988 | Japan | 123/590 |

*Primary Examiner*—Erick R. Solis
*Attorney, Agent, or Firm*—Donald A. Wilkinson

[57] ABSTRACT

An air induction system (10) for use with an internal combustion engine which includes a throttle body (24) mounted to an intake manifold housing (12). The manifold housing (12) includes an incoming flow passage (20) and a series of annular grooves (32). The annular grooves (32) are located between the throttle plate (30) and the incoming flow passage (20). These grooves (32) create turbulence in the air stream for improved performance under certain engine operating conditions and also act as moisture and contaminant traps.

13 Claims, 1 Drawing Sheet

ENGINE AIR INDUCTION SYSTEM

FIELD OF THE INVENTION

The present invention relates a to system and method for controlling air flow through an induction system of an internal combustion engine.

BACKGROUND OF THE INVENTION

The designs of intake manifolds used with internal combustion engines are becoming more flow efficient. As a result, the air flow through the intake system is becoming more laminar under certain engine operating conditions, especially those that employ lower flow rates. This can present concerns relative to a laminar air stream in the air intake system downstream from the throttle plate. This loss of flow turbulence results in an increased difficulty in properly mixing gases from engine systems such as the exhaust gas recirculation (EGR) system, the positive crankcase ventilation (PCV) system and the gas vapors absorbed from the fuel tank ventilation canister (EVAP) that are fed into the main airstream of the manifold downstream of the throttle body. Good mixing of the metered gasses in the main airstream is important for ideal engine operation.

The loss of flow turbulence also creates an increased concern over induction system noises, such as hoots and whistles (NVH), at the low air flow (idle and off idle) operating conditions. The noise can be generated from the airstream flow if resonance occurs from the connecting passages of the incoming flow of gases intersecting the main airstream (a "pop bottle" effect).

Furthermore, vehicle packages are becoming more restrictive and the past tradition of always providing a "positive drainback" away from the throttle plate to prevent moisture and sludge contamination on the throttle plate is an increasing challenge. Moisture and backflow of contaminants from the downstream air intake passage to the throttle plate can potentially create concerns with moisture freezing on the throttle plate or sludge building up on the throttle plate from the contaminates.

Hence, there is a desire to correct these concerns in an economical manner, while not greatly impacting a vehicle's weight nor increasing the room needed in the engine compartment for the air induction system, so as to avoid air induction system packaging concerns.

SUMMARY OF THE INVENTION

In its embodiments, the present invention contemplates an air induction system for use in an internal combustion engine. The system comprises a throttle body having an airflow surface defining a main airflow bore and a throttle plate mounted in the bore. The system further comprises an intake manifold housing mounted to the throttle body, downstream of the throttle body. The housing includes an air flow surface defining a main airflow passage aligned with the throttle body main bore, an incoming flow passage intersecting the main airflow passage, and a plurality of intake runners having intake passages intersecting the main airflow passage. The system also includes turbulence means, located downstream of the throttle plate and upstream of the incoming flow passage, for causing turbulence in the main air flow passage.

The invention further contemplates a method of improving the performance of an air induction system, having a throttle body, with a throttle plate, mounted to an intake manifold housing which includes a main airflow passage, through which air flows, and an incoming flow passage, for use in an internal combustion engine, the method comprising the steps of: flowing air through the throttle body and the airflow passage in the housing; creating turbulence in the air flow between the throttle plate and the incoming flow passage; and trapping backflowing contaminants between the throttle plate and the incoming flow passage.

Accordingly, an object of the present invention is to provide an improved engine air induction system in which engine operating conditions requiring low air flow in the air intake manifold, downstream of the throttle plate, create a turbulent flow for mixing gases from an incoming flow passage and which reduces the possibility of induction system noises from the air flow intersecting the entrance for the incoming flow of gases.

An advantage of the present invention is that the PCV, EGR and EVAP gases introduced into the main airstream can mix well while not creating a resonant noise condition in the throttle body and intake manifold. An additional advantage of the present invention is that it provides traps for moisture and backflow contamination, thus reducing the possibility of freezing and sludging of the throttle plate.

DETAILED DESCRIPTION OF THE PREFERRED EMBODIMENTS

Figure 1:
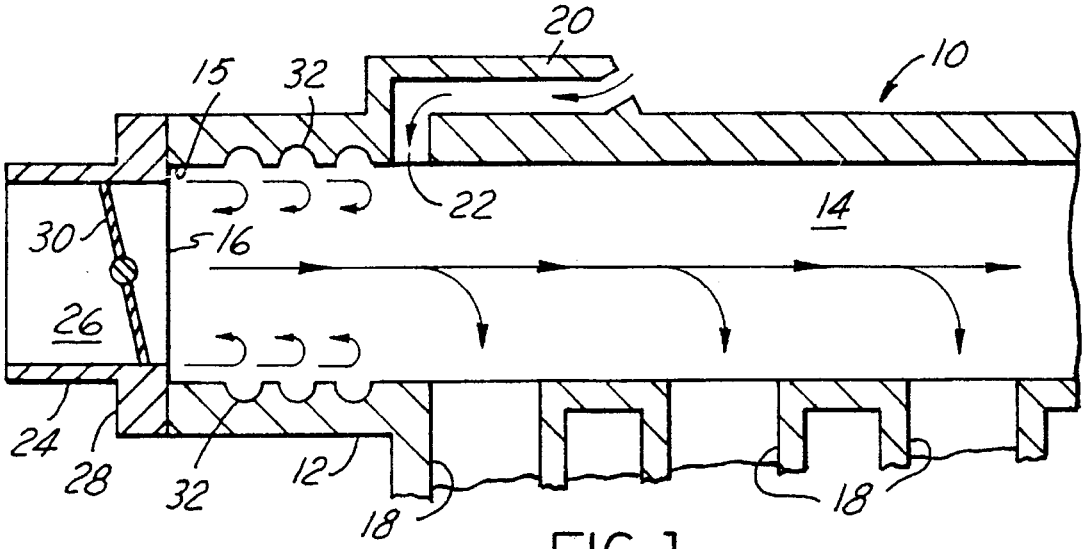
FIG. 1 is a cross-sectional view of a portion of an air intake system for an internal combustion engine.

An air induction system 10 is mounted to a typical internal combustion engine, not shown. The air induction system 10 includes an intake manifold housing 12 having a main airflow passage 14. The main airflow passage 14 includes an intake manifold inlet 16 for receiving air and an entrance surface 15 just downstream of the inlet 16. A series of intake runners 18, three shown in FIG. 1, protrude from the manifold housing 12 and allow air to exit the main airflow passage 14 and proceed to the engine's cylinders, not shown.

The intake manifold housing 12 also includes at least one incoming flow passage 20 having an opening 22 into the main airflow passage 14. This passage directs gases, such as EGR, PCV and EVAP, into the main airflow passage 14. Multiple passages can also be employed for metering these gases, if so desired. The main airflow passage 14 includes the intake air and the incoming gases, but does not include fuel mixed in with these components as in old carborated types of air intake systems. In these old systems, the need for mixing fuel and air for optimizing combustion was recognized, but not the mixing of air per se. In the present invention, fuel is mixed in with the air downstream of the main airflow passage 14, in the intake runners 18 or beyond.

A throttle body 24 includes a main airflow bore 26 aligned with the main airflow passage 14 and has a base 28 mounted to intake manifold housing 12. A throttle plate 30 is mounted within main airflow bore 26 and controls the amount of air flow through the throttle body 24, and hence, the amount of air flow through the main airflow passage 14.

The intake manifold housing 12 also includes three annular grooves 32 in the entrance surface 15 of the airflow passage 14. Other numbers and sizes of grooves can be used depending upon the amount of turbulence desired. The grooves 32 are aligned generally parallel with one another and have a semi-circular cross-section, although other cross-sectional shapes can also be used. The grooves 32 are located side-by-side, downstream from the intake manifold inlet 16 and up stream of the flow passage opening 22 and the intake runners 18. This changes the induction system flow geometry downstream of the throttle plate 30, which provides for different air flow. The grooves 32 can be formed by using processes such as being cast in, machined, molded or pressed into place depending upon the desired construction method.

At idle or off-idle engine operating conditions, the throttle plate 30 is substantially closed. Thus, the air flow through the main airflow bore 26 and the manifold airflow passage 14 is low. Under these conditions, the air flow in a throttle body and manifold can become laminar. Here, as the air flows into the intake manifold inlet 16, the air flowing along the surface of the main airflow passage 14 will encounter the annular grooves 32. The grooves 32 cause a disturbance in the air flow at the surface and thereby create more turbulence in the overall air flow.

There is turbulence in the air flow for the air flowing past the opening 22 of the flow passage 20. This turbulence will reduce the possibility of the air resonating as it passes the opening 22, causing hoots and whistles VH) from a "pop bottle" type of phenomenon. Further, the added turbulence will improve the overall mixing of the external metered gases (EGR, PCV and EVAP) entering the main airflow passage 14 from the flow passage 20, thus improving the consistency of the mixed gases and air entering each of the intake runners 18.

The annular grooves 32 also serve other purposes. When backflow toward the throttle plate occurs, contaminants and moisture will tend to become trapped in the grooves 32. The condensed moisture that is trapped will then be stored until it evaporates. The traps will thus reduce the possibility of moisture collecting on the throttle plate and freezing and also reduce the Sludge build-up on the throttle plate. Thus, the traps provide for alternative package options for throttle body/intake manifold orientations.

Figure 2:
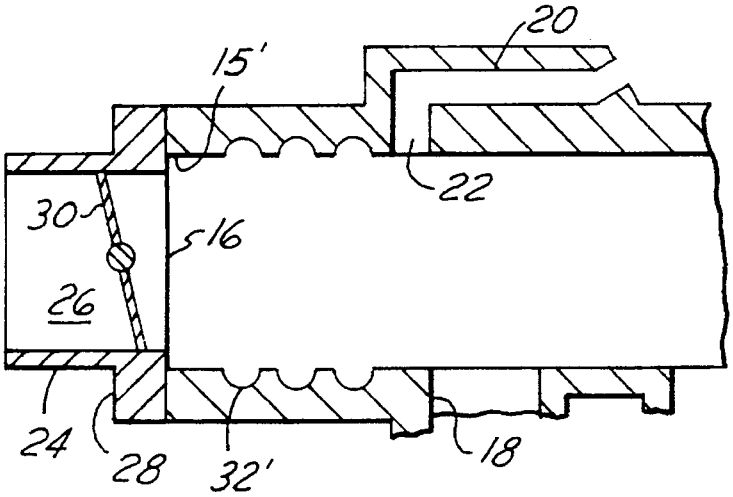
FIG. 2 is a cross-sectional view similar to FIG. 1, showing an alternate embodiment of the present invention.

An alternate embodiment is shown in FIG. 2. In this embodiment, similar components are similarly designated with the first embodiment, while changed parts are designated with an added prime. Entrance surface 15' tapers inward as it moves downstream and the annular grooves 32' are located on this tapered surface 15'. The taper causes an increase in the scrubbing action as the air flows past this surface.

Figure 3:
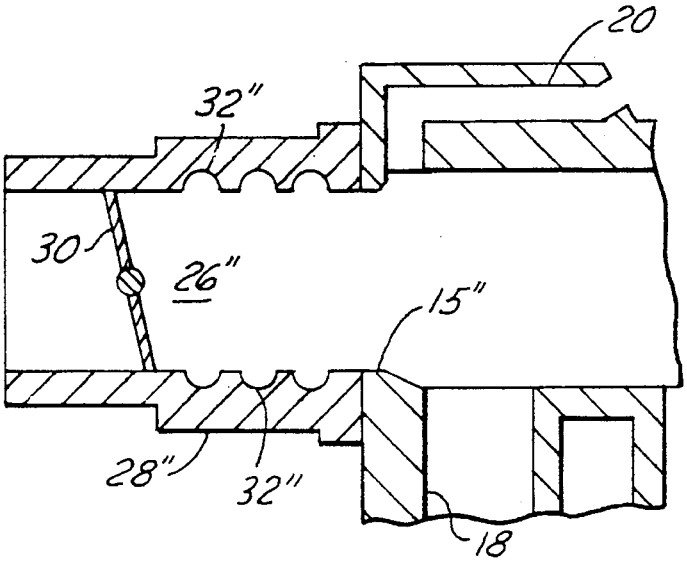
FIG. 3 is a cross-sectional view similar to FIG. 1, showing a second alternate embodiment of the present invention.

A second alternate embodiment is shown in FIG. 3. In this embodiment, similar components are similarly designated with the first embodiment, while changed parts are designated with an added double prime. The throttle base 28" is longer than the first embodiment and the entrance surface 15" is shorter. This allows the annular grooves 32" to be located on the surface of the main airflow bore 26'. The grooves 32" serve the same purpose as in the first embodiment. This location can be used simply for ease of manufacturing or packaging reasons, if so desired.

While certain embodiments of the present invention have been described in detail, those familiar with the art to which this invention relates will recognize various alternative designs and embodiments for practicing the invention as defined by the following claims.

I claim:

1. An air induction system for use in an internal combustion engine comprising:

a throttle body having an airflow surface defining a main airflow bore and a throttle plate mounted in the bore;

an intake manifold housing mounted to the throttle body, downstream of the throttle body, with the housing including an air flow surface defining a main airflow passage aligned with the throttle body main bore, an incoming flow passage intersecting the main airflow passage, and a plurality of intake runners having intake passages and the intake runners intersecting the main airflow passage; and turbulence means, located downstream of the throttle plate and upstream of the incoming flow passage, for causing turbulence in the main air flow passage.

2. The air induction system of claim 1 wherein the main airflow passage is oriented such that air generally flows in the main airflow passage in a direction other than vertical, whereby the turbulence means will also trap moisture and contaminates that may backflow toward the throttle plate.

3. The air induction system of claim 2 wherein the turbulence means comprises a plurality of annular grooves in the intake manifold housing along the surface of the main airflow passage.

4. The air induction system of claim 2 wherein the turbulence means comprises a plurality of grooves in the surface of the throttle body within the main airflow bore located between the throttle plate and the intake manifold housing.

5. The air induction system of claim 1 wherein the turbulence means comprises a plurality of annular grooves in the intake manifold housing along the surface of the main airflow passage.

6. The air induction system of claim 5 wherein each of the grooves is semi-circular in cross-section and located generally parallel with the other grooves.

7. The air induction system of claim 1 wherein the turbulence means comprises a plurality of grooves in the surface of the throttle body within the main airflow bore located between the throttle plate and the intake manifold housing.

8. The air induction system of claim 6 wherein the main airflow passage is oriented such that air generally flows in the main airflow passage in a direction other than vertical, whereby the turbulence means will also trap moisture and contaminates that may backflow toward the throttle plate.

9. An air induction system for use in an internal combustion engine comprising:

a throttle body having an airflow surface defining a main airflow bore and a throttle plate mounted in the bore;

an intake manifold housing mounted to the throttle body, downstream of the throttle body, with the housing including an air flow surface defining a main airflow passage aligned with the throttle body main bore and is oriented such that air generally flows in a direction other than vertical, an incoming flow passage intersecting the main airflow passage, and a plurality of intake runners having intake passages intersecting the main airflow passage; and a plurality of annular grooves in the intake manifold housing along the surface of the main airflow passage, located downstream of the throttle plate and upstream of the incoming flow passage, for causing turbulence in the main air flow passage and trapping moisture and contaminates that may backflow toward the throttle plate.

10. The air induction system of claim 9 wherein each of the grooves is semi-circular in cross-section and located generally parallel with the other grooves.

11. The air induction system of claim 10 wherein the main airflow passage is oriented such that air generally flows through it in a horizontal direction.

12. A method of improving the performance of an air induction system, having a throttle body, with a throttle plate, mounted to an intake manifold housing which includes a main airflow passage, through which air flows, and an incoming flow passage, for use in an internal combustion engine, the method comprising the steps of:

flowing air through the throttle body and the airflow passage in the housing;

creating turbulence in the air flow between the throttle plate and the incoming flow passage; and trapping backflowing contaminants between the throttle plate and the incoming flow passage.

13. The method of claim 12 further comprising trapping backflowing moisture between the throttle plate and the incoming flow passage.

* * * * *